US005921715A

United States Patent [19]

Rainey

[11] Patent Number: 5,921,715

[45] Date of Patent: Jul. 13, 1999

[54] RETAINING WALL AND METHOD

[75] Inventor: Thomas L. Rainey, Duluth, Ga.

[73] Assignee: Anchor Wall Systems, Inc., Minnetonka, Minn.

[21] Appl. No.: 08/846,440

[22] Filed: Apr. 30, 1997

[51] Int. Cl.[6] ..... E02D 29/02

[52] U.S. Cl. ..... 405/262; 405/284; 405/286

[58] Field of Search ..... 405/262, 284, 405/285, 280

[56] References Cited

U.S. PATENT DOCUMENTS

| | | | |
|---|---|---|---|
| 4,193,718 | 3/1980 | Wahrendorf et al. | 405/262 |
| 4,824,293 | 4/1989 | Brown et al. | 405/262 |
| 5,417,523 | 5/1995 | Scales | 405/262 |
| 5,511,910 | 4/1996 | Scales | 405/262 |
| 5,522,682 | 6/1996 | Egan | 405/262 |
| 5,607,262 | 3/1997 | Martin | 405/262 |

OTHER PUBLICATIONS

Nicholson Construction of America brochure for Insert Wall[SM] (In–Situ Earth Reinforcing Techniques), 5 pgs. (date unknown).

Manta Ray® Engineered Earth Anchor Systems brochure for anchoring technology, 4 pgs. (date unknown).

Newcastle™ Retaining Wall Systems brochure for retaining wall systems, 6 pgs., 1994.

*Primary Examiner*—Tamara Graysay
*Assistant Examiner*—Frederick L. Lagman
*Attorney, Agent, or Firm*—Thomas, Kayden, Horstemeyer & Risley, L.L.P.

[57] ABSTRACT

A retaining wall secured to a portion of earth, comprising a plurality of blocks stacked in longitudinally extending, vertically spaced tiers to define a retaining wall, each of the blocks defining a laterally oriented passageway extending between a pair of opposing sides thereof and having an exterior face orientated outwardly of the portion of the earth, the passageways being substantially aligned in each tier to define a channel within the tier of the retaining wall at least one tieback rod for being embedded at one end in a portion of earth to be covered by the retaining wall and having a protruding end extending therefrom towards the retaining wall at least one elongate member disposed within a portion of one of the channels in the tiers of blocks, the elongate member defining a slot through which the protruding end of the tieback rod extends and a mechanism for connecting the tieback rod to the elongate member to secure the retaining wall to the portion of earth. A method of constructing a retaining wall is disclosed.

34 Claims, 3 Drawing Sheets

RETAINING WALL AND METHOD

TECHNICAL FIELD

The present invention relates generally to retaining walls. More particularly, the present invention relates to retaining walls for construction in areas having soils that cannot be excavated due to limiting constraints.

BACKGROUND OF THE INVENTION

Earth retaining walls are elongated structures installed along embankments of earth to provide a barrier to slippage or movement of the embankment. Retaining walls are often installed on embankments formed while constructing recessed roadways, parking lots, buildings on terrace-type slopes, and the like. Retaining walls vary in height from a few feet to many tens of feet. The design of the earth retaining walls must account for lateral earth and water pressures, the weight of the wall, temperature and shrinkage effects, and other factors. In addition, the retaining walls typically have an attractive ornamental appearance on an exterior facade. For example, the ornamental design of some facades approximates the look of natural quarried stone. However, a variety of geometric patterns can also be created while forming precast blocks for use in assembling the retaining wall.

Retaining walls have found particular use in terraced construction. Terraced construction involves leveling areas of land and providing a sloping surface of earth between adjacent terraces. Often these terraces are used for constructing buildings, such as apartments or office buildings, and the adjacent terrace provides an area for parking, driveways and the like. The sloping surface between adjacent terraces typically is reinforced in order to prevent slippage of the sloping surface onto the lower terrace and thereby potentially damaging the foundation of the buildings on the upper terrace. Retaining walls are a typical type of reinforcement used on sloping surfaces. The retaining wall used to reinforce the sloping surface varies, including walls constructed of timbers, stones, blocks, and combinations. One type of timber reinforcing wall uses large timbers which are stacked one on top of another against the sloping surface. The stacks of timbers are thereafter secured together, such as with elongated bolts, screws, or pins.

Other retaining walls are assembled from stacks of interconnected cast blocks. Polymeric reinforcement sheets which define elongated lattice-like structures or grids extend laterally from the retaining wall. The grids interlock with the blocks using pins or connectors. The grid is covered with the earth and back fill placed between an interior face of the retaining wall and the earth. The grid thereby secures the wall to the earth and the back fill. However, construction of this type of retaining wall is typically done only for new construction, due to the difficulty and expense of inserting the grids into earth having existing foundations for buildings.

Yet another retaining wall anchors pairs of threaded rods in bedrock of the slope to be covered by the retaining wall. A tubular pipe is connected to the distal ends of the pairs of the rods. Cast blocks are stacked together to form a wall. During construction, a grid is attached to the wall between a first pair of tiers. The grid loops over the pipe between the pairs of rods and is then connected to the wall between two other tiers in an upper portion of the wall. The grid is then placed in tension by moving the pipe along the threaded rods laterally away from the wall. This is accomplished by threading nuts on the rods to push the pipe laterally from the wall. The space between the retaining wall and the slope is filled with earth backfill to lock the wall to the earth. However, this wall is not entirely satisfactory in that the grids significantly increase the cost of the retaining wall. Also, this type of wall requires sufficient space between the interior face of the retaining wall and the slope to be covered by the retaining wall in order for the grids to be stretched tightly to secure the wall to the earth. Further, insufficient space between the retaining wall and the surface to be covered prevents placing enough backfill over grids to lock the wall in place.

Still another type of retaining wall uses a combination of steel I-beams and interlocking wood planks. The I-beams are driven deeply into the earth by pile drivers. The I-beams are disposed with the U-shaped web on the sides of the beam facing laterally along the embankment to be secured by the retaining wall. A plurality of these I-beams are spaced-apart along the embankment. A plurality of wood beams are slidingly received in the webs of a pair of adjacent I-beams.

While these types of retaining walls have functioned over many years for securing earth slopes from slippage and movement, such walls age and decay, and thereby become weakened and have reduced capability for functioning as a retaining wall. Such retaining walls accordingly must be repaired or replaced periodically. In areas having terraced construction however this is a difficult problem. It may be extremely difficult to move the heavy equipment needed for constructing retaining walls into the driveways and parking lots of terraced construction. The foundations of buildings on upper terraces also may interfere with the ability to remove and install the grid-like reinforcing sheets. Removal of a wall for replacement with a new wall risks slope slippage and foundation damage to buildings during construction of the new retaining wall.

Accordingly, there remains a need in the art for an improved retaining wall and method of construction particularly for use in areas having existing buildings. It is to the provision of such that the present invention is directed.

SUMMARY OF THE PRESENT INVENTION

The present invention solves the need in the art by providing a retaining wall and a method of constructing a retaining wall to cover a sloped portion of earth, and particularly for constructing replacement retaining walls in areas having constraints, such as existing buildings, that prevent removal of the existing retained soil or rock. The method comprises the steps of embedding one end of at least one tieback rod within a portion of earth, whereby a protruding end extends outwardly freely from the portion of earth. A plurality of blocks are stacked in longitudinally extending tiers to define a retaining wall. Each of the blocks preferably has an ornamental exterior face which is oriented outwardly of the portion of earth. Each of the blocks defines a lateral passageway or core between a pair of opposing sides. The passageway of the blocks in each tier are substantially aligned to define a channel within the respective tier of said retaining wall. An elongate member is inserted into the channel in one of the tiers of blocks. The elongate member defines a slot for receiving the tieback rod therethrough. The tieback rod is then connected to the elongate member to secure the retaining wall to the portion of earth.

In a preferred embodiment of the method, a washer slides onto the tieback rod and a nut threadingly engages the tieback rod to connect the tieback rod to the elongate member. The elongate member distributes the load of the connection uniformly across the blocks contacted by the elongate member. Two of the blocks are spaced-apart to define a gap in the wall through which the tieback rod extends in order to be connected to the elongate member. The gap is closed by securing an ornamental plate to side edges of the two blocks. In another embodiment, one of the blocks is notched in a side portion to provide an opening in the wall for receiving the tieback rod into the channel.

The present invention meets the need in the art by providing a retaining wall that is secured to a portion of earth. The retaining wall comprises a plurality of blocks stacked in longitudinally extending tiers. Each of the blocks preferably have an ornamental exterior face which is orientated outwardly of the portion of the earth. Each of the blocks defines a laterally oriented passageway extending between a pair of opposing sides thereof. The passageways in the blocks in each tier are substantially aligned to define a channel within the respective tier. At least one tieback rod is embedded at one end in a portion of earth to be covered by the retaining wall. The protruding end of the tieback rod extends therefrom towards the retaining wall. At least one elongate member is disposed within a portion of one of the channels in the tiers of blocks. The elongate member defines a slot through which the protruding end of the tieback rod extends. The tieback rod connects to the elongate member to secure the retaining wall to the portion of earth.

In preferred embodiment, a nut and washer connect the tieback rod to the elongate member. The elongate member extends longitudinally through at least a pair of the blocks. The load on the wall created by securing the tieback rod to the elongate member is distributed uniformly across the blocks being contacted by the elongate member. Preferably, two blocks are disposed in spaced-apart relation to define a gap in the retaining wall through which the tieback rod extends in order to engage the elongate member. The gap is closed on the exterior side of retaining wall by securing an ornamental plate to side edges of the two blocks. In an alternative embodiment, one of the blocks includes a notch in a side thereof and the tieback rod extends therethrough into the channel in the tier in order to be connected to the elongate member.

Objects, features and advantages of the present invention will become apparent upon reading the following detailed description of the disclosed embodiment of the present invention, in conjunction with the appended drawings and claims.

DETAILED DESCRIPTION OF THE PREFERRED EMBODIMENTS

Figure 1:
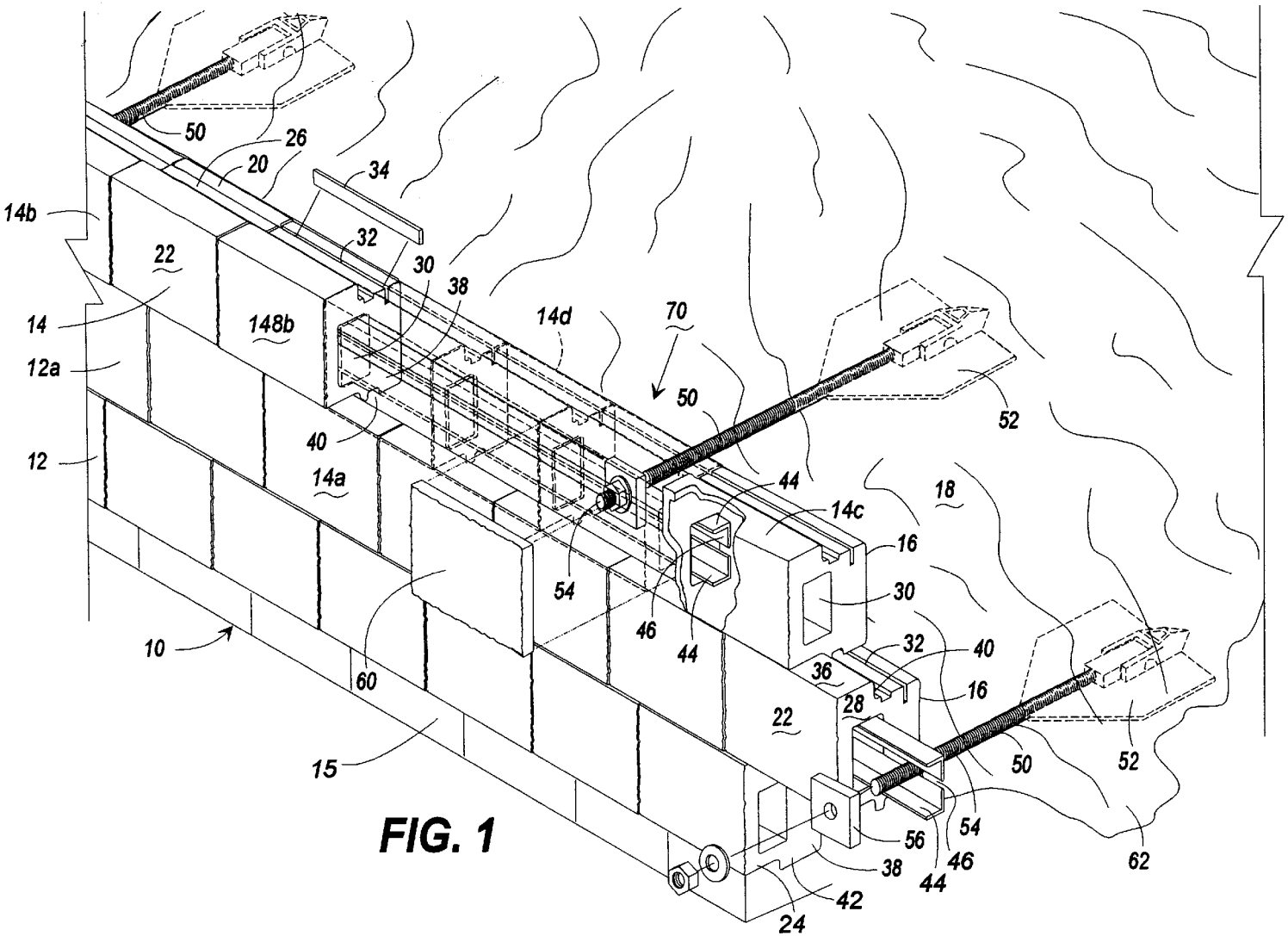
FIG. 1 is a perspective view of a retaining wall according to the present invention.

Referring now in more detail to the drawings in which like parts have like identifiers, FIG. 1 is a perspective partially cut-away view of a retaining wall 10 made in accordance with the present invention. The retaining wall 10 comprises at least two tiers 12 of blocks 14 stacked together. In the illustrated embodiment, the wall 10 is constructed on base blocks 15. The blocks 14 in each tier 12 are placed side-by-side to form the elongated retaining wall 10 having an interior side 16 facing a slope of earth generally 18 to be covered by the retaining wall.

Each block 14 has an interior face 20 and an exposed exterior face 22. In a preferred embodiment, the exposed face 22 includes an ornamental surface for defining an attractive facade for the wall 10. The block 14 has a bottom surface 24 and an upper surface 26. The block 14 has side faces 28. A laterally oriented opening 30 or passageway extends through the block 14 between the side faces 28. The passageway 30 is known in the trade as a "core" which refers to forming the passageway during casting of the block in a mold. The illustrated embodiment of the block 14 further includes a lateral alignment slot 32. The slot 32 is a narrow channel extending inwardly into the block 14 from the top surface 26. The slot 32 receives an elongated rod generally 34 during installation of a tier 12 for aligning adjacent blocks 14.

The illustrated embodiment of the block 14 includes a raised portion 36 between the exterior face 22 and the upper channel 34. Similarly, the lower surface 24 includes a depending portion 38. The raised portion 36 and the depending portion 38 each define notches 40 and 42 in the upper surface 26 and the lower surface 24 of the block 14 respectively. The notch 40 in the block 14*a* in the lower tier 12*a* matingly nests with the depending portion 38 of the block 14*b* in the adjacent upper tier 14*b*. Accordingly, the blocks 14 nestingly stack together to define the wall 10 having the tiers 12. A pair of angle members 44 are slidingly received within the passageway 30. In the illustrated embodiment, the pair of angle members are spaced-apart to define a slot 46. The angle members 44 are elongated and extend across a plurality of the blocks 14, for a purpose discussed below.

A plurality of tieback rods 50 extend laterally from the face of the slope 18. Each of the tieback rods 50 is secured in the earth with conventional anchors 52. A distal end 54 of the tieback rod 50 extends to the wall 10 and through the slot 46 defined by the angle members 44. A plate washer 56 is slidingly received on the rod 50. A nut 58 threadingly engages the tieback rod 50 to secure the tieback rod to the angle member 44.

Figure 2:
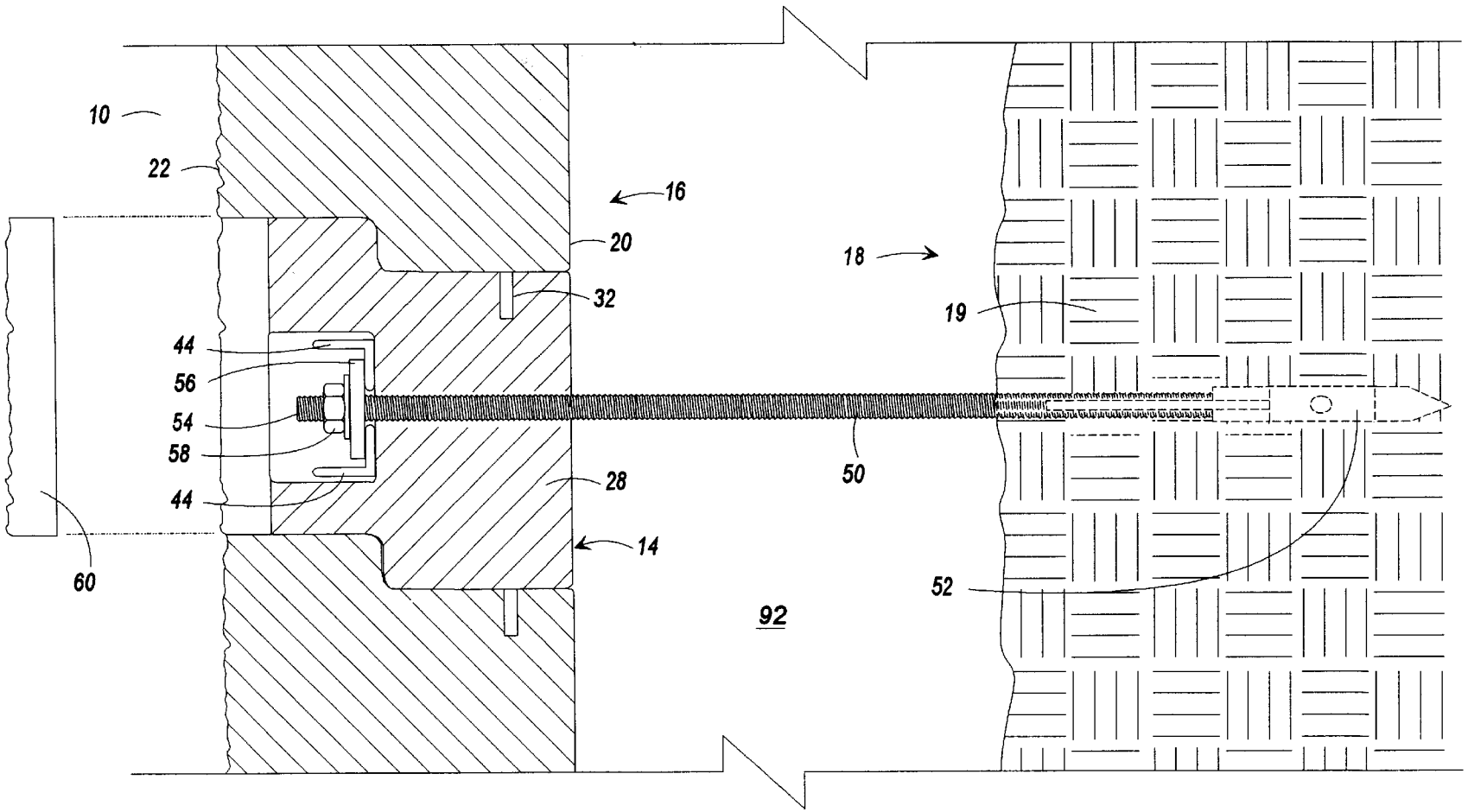
FIG. 2 is a side cross-sectional view of the retaining wall illustrated in FIG. 1.

FIG. 2 is a cross-sectional view of a portion of the wall 10 to illustrate features of the present invention. The tieback rod 50 is preferably a threaded steel rod which is secured by the anchor 52 in a bore in the earth 18 generally designated 19. The tie-rods 50 and anchors 52 are secured in the bores mechanically or with an adhesive. The nut 58 and washer 56 secure the tie bar 50 to the angle members 44. A face portion 60 is cut from one of the blocks 14 for being received between two adjacent blocks 14 in the wall 10 to close the portion of the wall where the tieback rod 50 is connected to the wall.

Figure 3:
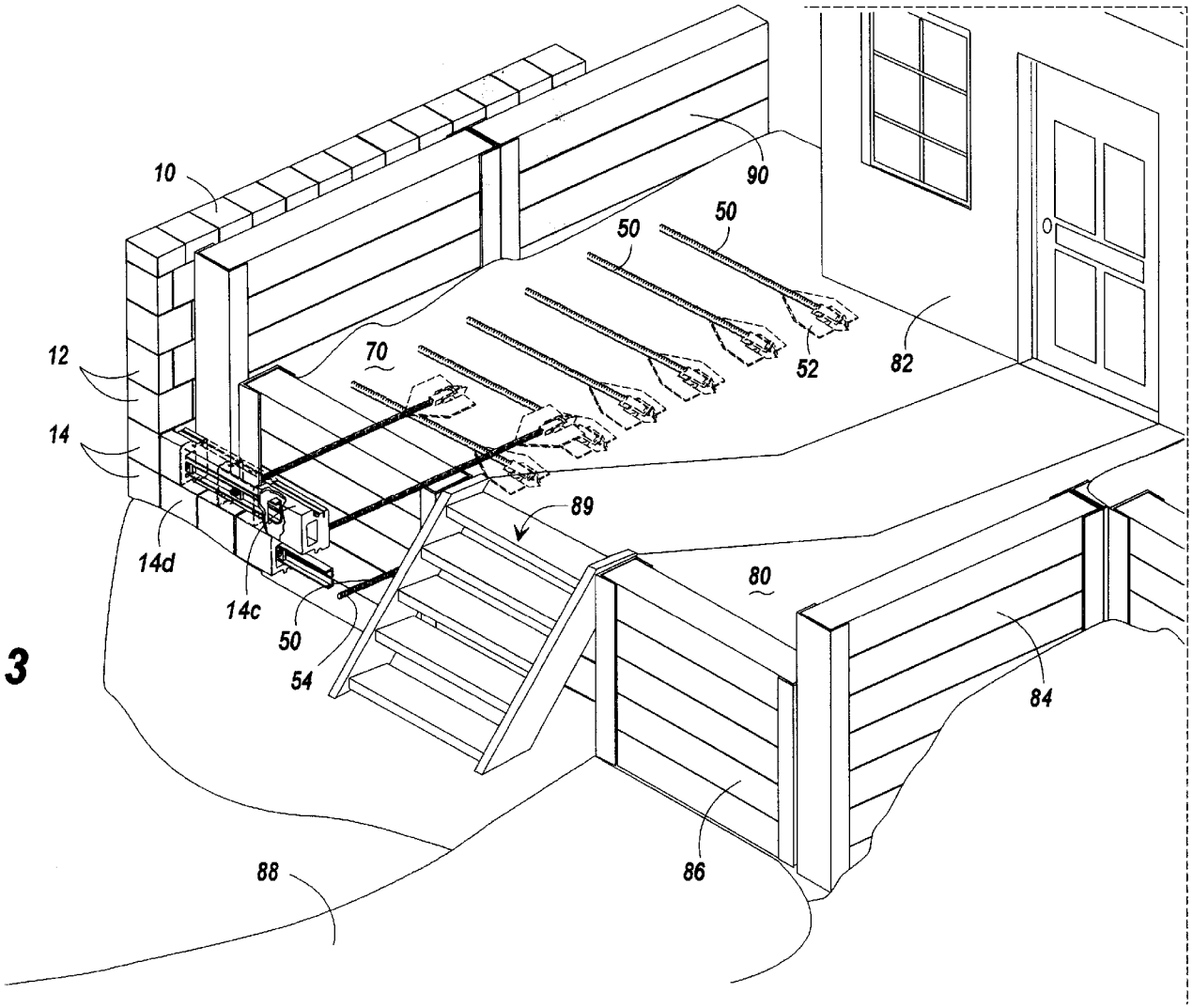
FIG. 3 is a perspective view illustrating an environment in which the retaining wall of the present invention is useful.

FIG. 3 is a perspective view illustrating typical terrace construction in which the present invention is particularly useful. An upper terrace 80 includes a building 82 having foundations driven into a portion of earth generally designated 84. The upper terrace 80 is separated by a sloped surface 86 from a lower terrace 88 which in the illustrated embodiment is a parking lot, with stairs 89 leading between the terraces 80 and 88. A portion of the upper terrace 80 is reinforced with a steel and wood retaining wall generally designated 90. The retaining wall 10 of the present invention is useful for placing an ornamental facade over such ornamentally lacking retaining walls or to provide a new reinforcing wall as a replacement for retaining walls which have degraded or deteriorated. The retaining wall 10 is readily constructed without having to move large cranes or pile drivers onto the site and is readily constructed without interfering with foundations for the buildings 82.

A plurality of bores are drilled through the retaining wall 90 and into the soil or rock of the raised terrace 84.

Conventional anchors and tieback rods 50 are secured in the bores. In a preferred embodiment, the tieback rods 50 and the anchors are secured mechanically or with adhesive. The distal ends 54 of the tie bars 50 extend outwardly of the terraced earth 84. Similarly, the bores can be drilled directly into a slope to be covered by a retaining wall.

The blocks 14 are then placed side-by-side and stacked in tiers 12 to erect the wall 10. With reference to FIG. 1, as the wall 10 reaches a height approximately the height of one of the tie bars 50 protruding from the earth, a pair of the angle members 44 are slidingly inserted into the opening 30 in the tier 12*a* of blocks 14. The angle members 44 may be joined together by a plate (not illustrated) to maintain the spacing of the slot 46. The angle members 44 define an elongated member having a slot for receiving the tie bar 50. The distal end 54 of the tie bar 50 is slidingly received within the slot 46 defined by the angle irons 60. The plate washer 56 is positioned over the distal end 54 of the tie bar 50. The nut 58 threadingly engages the tie bar 50 and is tightened against the washer 56 and the angle members 44 to secure the wall 10 to the earth 84. As best illustrated in FIG. 1, the angle members 44 are disposed along a plurality of the blocks 14. In this way, the load imposed on the wall is uniformly distributed across the wall 10 by the angle members 44. Prior to fully tightening the nut 58 to the tie bar 50, additional blocks 14 are positioned in the tier 12. Preferably, the next block 14*c* is spaced-apart from the prior block 14*d* to leave a gap 70 in the wall where the tieback rod 50 is secured with the nut 58 to the angle irons 44, as best illustrated in FIG. 1. To close the gap 70 between the blocks 14*c* and 14*d*, the face portion 60 containing the exterior face 22 is severed from another of the blocks 14. The face portion 60 is then secured to the adjacent blocks 14*c* and 14*d* with adhesive. The remainder of the wall 10 is similarly constructed by positioning blocks 14 in tiers, inserting angle members 44 into the openings 30 for engagement to tieback rods 50, until the wall is constructed. In an alternative embodiment, a notch 98 is cut in the side wall 28 for receiving the tieback rod 50. In this embodiment, the blocks 14 are positioned side-by-side, without the gap 70.

In the embodiment illustrated in FIG. 3, the retaining wall 10 is positioned in close relation to the existing retaining wall 90. However, as illustrated in FIG. 2, the retaining wall 10 can be spaced apart from the earth surface 19 to be secured by the retaining wall 10. This defines a space 92 generally between the interior face 16 of the retaining wall 10 and the face of the earth 18. The space 92 defined by this gap is preferably filled with stone fill as backfill. The blocks 14 and tieback rods 50 accordingly provide a readily constructed retaining wall 10 for retro-fit application in areas having constraints which limit excavation of soil, such as existing construction or embankment where it is difficult to build conventional retaining walls. It is to be noted however that the present invention is equally useful in construction of new retaining walls.

The principles, preferred embodiments and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. A method of constructing a retaining wall near a portion of earth to be retained thereby, comprising the steps of:

(a) embedding one end of at least one tieback rod within a portion of earth, whereby a protruding end extends outwardly freely from the portion of earth;

(b) stacking a plurality of blocks in longitudinally extending tiers to define a retaining wall, each of said blocks defining a laterally oriented passageway between a pair of opposing sides thereof said passageways being substantially aligned in each tier to define a channel within said tier of said retaining wall;

(c) inserting an elongate member into the channel in one of the tiers of blocks, said elongate member defining a slot for receiving said tieback rod therethrough;

(d) orienting the tieback rod with respect to the elongate member such that the protruding end of the rod extends through the slot; and (e) connecting said tieback rod to said elongate member to secure said retaining wall to said portion of earth.

2. The method of constructing a retaining wall as recited in claim 1, wherein the connecting step (e) comprises the steps of:

(e) sliding a washer onto a distal end of said tieback rod and into contact with said elongate member; and (f) threading a nut onto the distal end of said tieback rod to bear firmly against said washer, whereby the tieback rod, being engaged to the elongate member, connects the retaining wall to the portion of earth.

3. The method of constructing a retaining wall as recited in claim 1, comprising the step of disposing the elongate member longitudinally through at least a pair of the blocks, whereby the load on the wall created by securing the tieback rod to the elongate member is distributed uniformly across the blocks being contacted by said elongate member.

4. The method of constructing a retaining wall as recited in claim 1, further comprising the step of positioning two blocks in a spaced-apart relation in the tier to define a gap in the retaining wall for receiving the tieback rod in the elongated member.

5. The method of constructing a retaining wall as recited in claim 4, further comprising the step of closing the exterior side of retaining wall by securing an ornamental plate to side edges of the ornamental faces of the two blocks.

6. A retaining wall secured to a portion of earth, comprising:

a plurality of blocks stacked in longitudinally extending, vertically spaced tiers to define a retaining wall, each of said blocks defining a laterally oriented passageway extending between a pair of opposing sides thereof and having an exterior face orientated outwardly of the portion of the earth, said passageways being substantially aligned in each tier to define a channel within said tier of said retaining wall;

at least one tieback rod for being embedded at one end in a portion of earth to be covered by said retaining wall and having a protruding end extending therefrom into said retaining wall;

at least one elongate member disposed within a portion of one of the channels in the tiers of blocks, said elongate member defining a slot through which the protruding end of said tieback rod extends; and means for connecting said tieback rod to said elongate member to secure said retaining wall to said portion of earth.

7. The retaining wall as recited in claim 6, wherein the connecting means comprises:

a washer slidably received onto a distal end of said tieback rod and in contact with said elongate member; and a nut threaded onto the distal end of said tieback rod and bearing against said washer, whereby the tieback rod, being engaged to the elongate member, connects the retaining wall to the portion of earth.

8. The retaining wall as recited in claim 6, wherein said elongate member extends longitudinally through at least a pair of the blocks, whereby the load on the wall created by securing the tieback rod to the elongate member is distributed uniformly across the blocks being contacted by said elongate member.

9. The retaining wall as recited in claim 6, wherein said tieback member is engaged to said elongate rod in a gap in the retaining wall defined by two of said blocks being disposed in spaced-apart relation.

10. The retaining wall as recited in claim 9, wherein said gap is closed on the exterior side of retaining wall with a plate that is secured to side edges of the ornamental faces of the two blocks.

11. A method of anchoring a retaining wall to a portion of earth, the retaining wall being constructed of a plurality of blocks stacked in longitudinally extending tiers and each having a laterally oriented passageway extending therethrough, the block passageways of at least one tier being aligned to define an elongated channel, the method comprising the steps of:

(a) embedding at least one tieback rod within the portion of earth such that a protruding end of the tieback rod extends into the elongated channel of the retaining wall;

(b) inserting an elongate member into the elongated channel, the elongate member defining a slot for receiving the tieback rod therethrough;

(c) orienting the tieback rod within the elongated channel such that the protruding end of the tieback rod extends through the slot; and (d) connecting the tieback rod to the elongate member to secure the retaining wall to the portion of earth.

12. The method of claim 11, further comprising the step of inserting a second elongate member into the elongated channel of the retaining wall such that a pair of elongate members are disposed within the elongated channel, wherein the pair of elongate members together define the slot through which the tieback rod extends.

13. The method of claim 12, wherein each of the elongate members comprises an angle member.

14. The method of claim 11, wherein the step of inserting an elongate member into the elongated channel comprises disposing the elongate member through at least three of the blocks.

15. The method of claim 11, wherein the step of connecting the tieback rod to the elongate member comprises sliding a washer onto the protruding end of the tieback rod and threading a nut onto the protruding end such that it firmly bears against the washer.

16. A retaining wall system for retaining a portion of earth, comprising:

a retaining wall including a plurality of blocks stacked in longitudinally extending tiers, each of said blocks of at least one of said tiers having a laterally oriented passageway extending therethrough, said blocks of said at least one of said tiers being arranged such that said laterally oriented passageways align to form an elongated channel in said at least one of said tiers;

at least one tieback rod adapted to be embedded into the portion of earth with a protruding end of said at least one tieback rod extending outwardly from the portion of earth, said protruding end extending into said elongated channel formed in said retaining wall;

at least one elongate member disposed within said elongated channel formed in said retaining wall, said at least one elongate member defining a slot through which said protruding end of said tieback rod extends; and means for connecting said tieback rod to said elongate member to secure said retaining wall to the portion of earth.

17. The retaining wall system of claim 16, further comprising a second elongate member disposed within said elongated channel of said retaining wall such that a pair of elongate members are disposed within said elongated channel, wherein said pair of elongate members together define said slot through which said tieback rod extends.

18. The retaining wall system of claim 17, wherein each of said elongate members comprises an angle member.

19. The retaining wall system of claim 16, wherein said elongate member extends through at least three of said blocks.

20. The retaining wall system of claim 16, wherein said means for connecting said tieback rod to said elongate member comprises a nut tightly threaded onto said protruding end of said tieback rod and a washer disposed between said nut and said elongate member.

21. A method of constructing a retaining wall near a portion of earth to be retained thereby, comprising the steps of:

(a) embedding one end of at least one tieback rod within a portion of earth, whereby a protruding end extends outwardly freely from the portion of earth;

(b) stacking a plurality of blocks in longitudinally extending tiers to define a retaining wall, each of said blocks defining a laterally oriented passageway between a pair of opposing sides thereof said passageways being substantially aligned in each tier to define a channel within said tier of said retaining wall;

(c) inserting an elongate member into the channel in one of the tiers of blocks, said elongate member defining a slot for receiving said tieback rod therethrough; and (d) connecting said tieback rod to said elongate member to secure said retaining wall to said portion of earth by sliding a washer onto a distal end of said tieback rod and into contact with said elongate member and threading a nut onto the distal end of said tieback rod to bear firmly against said washer, whereby the tieback rod, being engaged to the elongate member, connects the retaining wall to the portion of earth.

22. A method of constructing a retaining wall near a portion of earth to be retained thereby, comprising the steps of:

(a) embedding one end of at least one tieback rod within a portion of earth, whereby a protruding end extends outwardly freely from the portion of earth;

(b) stacking a plurality of blocks in longitudinally extending tiers to define a retaining wall, each of said blocks defining a laterally oriented passageway between a pair of opposing sides thereof said passageways being substantially aligned in each tier to define a channel within said tier of said retaining wall;

(c) positioning two blocks in a spaced-apart relation in the tier to define a gap in the retaining wall for receiving the tieback rod in the elongated member;

(d) inserting an elongate member into the channel in one of the tiers of blocks, said elongate member defining a slot for receiving said tieback rod therethrough;

(e) connecting said tieback rod to said elongate member to secure said retaining wall to said portion of earth; and (f) closing the exterior side of the retaining wall by securing an ornamental plate to side edges of the ornamental faces of said two blocks.

23. A method of constructing a retaining wall near a portion of earth to be retained thereby, comprising the steps of:

(a) embedding one end of at least one tieback rod within a portion of earth, whereby a protruding end extends outwardly freely from the portion of earth;

(b) stacking a plurality of blocks in longitudinally extending tiers to define a retaining wall, each of said blocks defining a laterally oriented passageway between a pair of opposing sides thereof said passageways being substantially aligned in each tier to define a channel within said tier of said retaining wall;

(c) cutting a notch in a side portion of one of said blocks for receiving the tieback rod therethrough;

(d) inserting an elongate member into the channel in one of the tiers of blocks, said elongate member defining a slot for receiving said tieback rod therethrough; and (e) connecting said tieback rod to said elongate member to secure said retaining wall to said portion of earth.

24. A retaining wall secured to a portion of earth, comprising:

a plurality of blocks stacked in longitudinally extending, vertically spaced tiers to define a retaining wall, each of said blocks defining a laterally oriented passageway extending between a pair of opposing sides thereof and having an exterior face oriented outwardly of the portion of the earth, said passageways being substantially aligned in each tier to define a channel within said tier of said retaining wall;

at least one tieback rod for being embedded at one end in a portion of earth to be covered by said retaining wall and having a protruding end extending therefrom towards said retaining wall;

at least one elongate member disposed within a portion of one of the channels in the tiers of blocks, said elongate member defining a slot through which the protruding end of said tieback rod extends;

a washer slidably received onto a distal end of said tieback rod and in contact with said elongate member; and a nut threaded onto the distal end of said tieback rod and bearing against said washer;

whereby the tieback rod, being engaged to the elongate member, connects the retaining wall to the portion of earth.

25. The retaining wall of claim 24, further comprising a second elongate member disposed within said elongated channel of said retaining wall such that a pair of elongate members are disposed within said elongated channel, wherein said pair of elongate members together define said slot through which said tieback rod extends.

26. The retaining wall of claim 25, wherein each of said elongate members comprises an angle member.

27. A retaining wall secured to a portion of earth, comprising:

a plurality of blocks stacked in longitudinally extending, vertically spaced tiers to define a retaining wall, each of said blocks defining a laterally oriented passageway extending between a pair of opposing sides thereof and having an exterior face oriented outwardly of the portion of the earth, said passageways being substantially aligned in each tier to define a channel within said tier of said retaining wall;

at least one tieback rod for being embedded at one end in a portion of earth to be covered by said retaining wall and having a protruding end extending therefrom towards said retaining wall;

at least one elongate member disposed within a portion of one of the channels in the tiers of blocks, said elongate member defining a slot through which the protruding end of said tieback rod extends, wherein said tieback member is engaged to said elongate member in a gap in the retaining wall defined by two of said blocks disposed in spaced-apart relation, said gap being closed on the exterior side of the retaining wall by a plate secured to side edges of the ornamental faces of the two blocks; and means for connecting said tieback rod to said elongate member to secure said retaining wall to said portion of earth.

28. The retaining wall of claim 27, further comprising a second elongate member disposed within said channel such that a pair of elongate members are disposed within said elongated channel, wherein said pair of elongate members together define said slot through which said tieback rod extends.

29. The retaining wall of claim 28, wherein each of said elongate members comprises an angle member.

30. The retaining wall of claim 27, wherein said means for connecting said tieback rod to said elongate member comprises a nut tightly threaded onto said protruding end of said tieback rod and a washer disposed between said nut and said elongate member.

31. A retaining wall secured to a portion of earth, comprising:

a plurality of blocks stacked in longitudinally extending, vertically spaced tiers to define a retaining wall, at least one of said blocks including a notch in a side thereof, each of said blocks defining a laterally oriented passageway extending between a pair of opposing sides thereof and having an exterior face oriented outwardly of the portion of the earth, said passageways being substantially aligned in each tier to define a channel within said tier of said retaining wall;

at least one tieback rod for being embedded at one end in a portion of earth to be covered by said retaining wall and having a protruding end extending therefrom towards said retaining wall, said at least one tieback rod extending through the notch provided in said at least one block and into one of said channels;

at least one elongate member disposed within a portion of one of the channels in the tiers of blocks, said elongate member defining a slot through which the protruding end of said tieback rod extends; and means for connecting said tieback rod to said elongate member to secure said retaining wall to said portion of earth.

32. The retaining wall of claim 31, further comprising a second elongate member disposed within said channel such that a pair of elongate members are disposed within said elongated channel, wherein said pair of elongate members together define said slot through which said tieback rod extends.

33. The retaining wall of claim 32, wherein each of said elongate members comprises an angle member.

34. The retaining wall of claim 31, wherein said means for connecting said tieback rod to said elongate member comprises a nut tightly threaded onto said protruding end of said tieback rod and a washer disposed between said nut and said elongate member.

* * * * *